US005933682A

United States Patent [19]

Rushing

[11] Patent Number: 5,933,682

[45] Date of Patent: Aug. 3, 1999

[54] COPIER/PRINTER WITH MANUAL ADJUSTMENT FOR CROSS-TRACK UNIFORMITY

[75] Inventor: Allen Joseph Rushing, Webster, N.Y.

[73] Assignee: Eastman Kodak Company, Rochester, N.Y.

[21] Appl. No.: 09/059,810

[22] Filed: Apr. 14, 1998

[51] Int. Cl.[6] ..... G03G 15/43

[52] U.S. Cl. ..... 399/51; 399/52; 347/115; 347/117; 347/118; 347/130; 347/131; 347/237; 347/238

[58] Field of Search ..... 399/38, 75, 51, 399/52; 347/130, 131, 132, 140, 237, 238, 240, 115, 116, 117, 118

[56] References Cited

U.S. PATENT DOCUMENTS

| | | | |
|---|---|---|---|
| 3,914,047 | 10/1975 | Hunt, Jr. et al. . | |
| 4,748,465 | 5/1988 | Tsilibes et al. | 346/160 |
| 5,200,765 | 4/1993 | Tai . | |
| 5,253,934 | 10/1993 | Potucek et al. . | |
| 5,257,039 | 10/1993 | Chung et al. . | |
| 5,300,960 | 4/1994 | Phan et al. . | |
| 5,384,592 | 1/1995 | Wong | 346/157 |
| 5,517,328 | 5/1996 | Wilson | 358/471 |
| 5,546,165 | 8/1996 | Rushing et al. . | |
| 5,596,353 | 1/1997 | Takada et al. . | |
| 5,600,408 | 2/1997 | Horiuchi et al. | 399/39 |
| 5,657,069 | 8/1997 | Kelly et al. . | |
| 5,745,142 | 4/1998 | Liston | 347/116 |
| 5,778,280 | 3/1996 | Komiya et al. | 399/49 |

*Primary Examiner*—Matthew S. Smith
*Assistant Examiner*—Shival Virmani
*Attorney, Agent, or Firm*—Norman Rushefsky

[57] ABSTRACT

An electrostatographic reproduction method and apparatus includes an electrostatic recording member moving in a process direction. A plurality of recording elements on a writer imagewise expose the recording member to form electrostatic latent images on the recording member. The writer includes driver circuitry for actuating selected recording elements. The exposed recording member is then moved through a development station to develop the latent images. The developed images are transferred to a record member. An operator selectable adjustment controller is manually adjusted for generating adjustments in operation of the recording elements to compensate for a misalignment of a process station in the apparatus.

19 Claims, 7 Drawing Sheets

COPIER/PRINTER WITH MANUAL ADJUSTMENT FOR CROSS-TRACK UNIFORMITY

FIELD OF THE INVENTION

The present invention relates to electrostatographic copiers and/or printers and more particularly to methods and apparatus for providing simplified control over density consistency and uniformity in such copiers and/or printers.

BACKGROUND OF THE INVENTION

In the prior art as presented by U.S. Pat. No. 5,546,165, by Rushing et al, there is disclosed an electrostatographic copier/printer with adjustable process control parameters wherein image contrast and color balance can be adjusted. The process control parameters considered adjustable are initial or primary charge, $V_o$, exposure $E_o$ and developer bias $V_B$.

The copier/printer described in Rushing et al is specifically directed to overcoming the problem of non-uniformities in reproductions that are associated with a direction that is cross-track to the process direction. Such non-uniformities cannot be well accommodated by making overall process changes.

In order to overcome this problem, the copier/printer described in Rushing et al provided for the printing of special test images. These printed test images are then delivered and fed into a scanner. The scanned data are analyzed to characterize the overall process in terms of cross-track uniformity and deviation from desired tone scale. The Rushing et al patent recognizes that cross-track nonuniformity and deviation from desired tone scale may result from misalignment of one or more process stations for example an exposure station, a charging station or a development station. Thus, z-axis skewing (tilt) of the LED printhead and/or Selfoc lens which focuses light from the LEDs (light-emitting diodes) onto the photoconductive surface can provide for a non-uniformity. Other recognized potential problems are the tilt of the primary charger or non-parallelism of the development station relative to the photoconductor. The Rushing et al patent proposes that, as a result of the scanning, adjustments can be made in LED exposure on-time or driver current to correct for same.

A problem with the apparatus of the prior art is that a scanner is required to provide for correction for such non-uniformities. The tilt and bow non-uniformities are the most common and most objectionable.

In the printer art generally, it is also known to detect non-uniformities using a visual detection by an operator and correction can be provided by adjustment of signals to each of the recording elements. In this regard, reference may be had to U.S. Pat. No. 5,596,353.

A problem with the above apparatus is that where several thousand recording elements are arranged on the printhead, it becomes relatively cumbersome to provide the manual correction suggested in this patent except where only a relatively few recording elements require correction, a situation not typical in a tilt or skew or bow situation.

It is an object of the invention therefore to provide for an improved control of cross-track non-uniformity in a reproduction apparatus.

Accordingly, it is an object of the present invention to provide an electrostatographic copier and/or printer apparatus and method for adjusting for cross-track non-uniformities without the need of a scanner to scan a test print printed by the apparatus and without the need for an operator to identify specific recording elements and provide specific corrections to specific recording elements.

SUMMARY OF THE INVENTION

The above and other objects of the invention are realized by an electrostatographic recording apparatus and method comprising an electrostatographic recording member that is moving in a process direction; operating a plurality of recording elements on a writer to imagewise expose the recording member to form electrostatic latent images on the recording member, the writer including driver circuitry for actuating selected recording elements; moving the exposed recording member through a development station to develop the latent images; transferring developed images to a record member; and manually adjusting an operator selectable adjustment controller for generating adjustments in operation of the recording elements to compensate for a misalignment of a process station in the apparatus.

BRIEF DESCRIPTION OF THE DRAWINGS

In the detailed description of the preferred embodiments of the invention presented below, reference is made to the accompanying drawings in which.

DETAILED DESCRIPTION OF THE PREFERRED EMBODIMENTS

Because electrostatographic apparatus of the type described herein are well known, the present description will be directed in particular to elements forming part of or cooperating more directly with the present invention.

Figure 1:
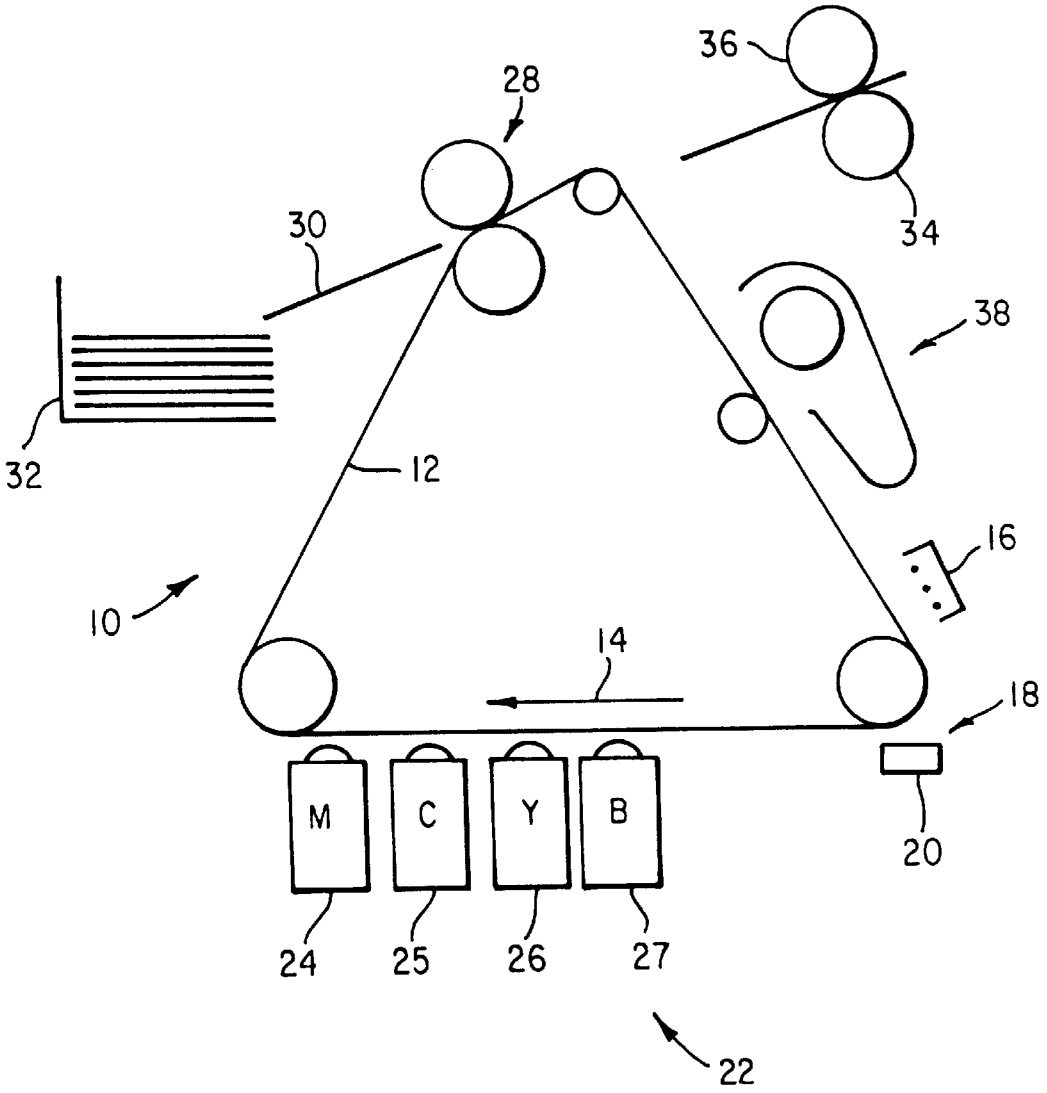
FIG. 1 is a side elevational view in schematic form of an electrostatographic copier/printer apparatus suitable for use in the present invention.

Referring to FIG. 1, an electrostatographic machine 10 has an image transfer member such as photoconductive belt 12. Belt 12 is moved in a clockwise direction, as represented by arrow 14. A photoconductive drum may be used instead of a belt.

A charging station 16 including for example a corona or other type of primary charger applies a uniform electrostatic primary charge to belt 12. At an exposure station 18, projected light from a writehead 20 dissipates the electrostatic charge on the photoconductive belt to form a latent electrostatic image corresponding to the image of an original to be copied or printed. Writehead 20 preferably has an array of light-emitting diodes (LEDs) for exposing the photoconductive belt. The array typically comprises a single row of several thousand LEDs arranged in a direction cross-track to the movement of the belt in the process direction. Preferably, a gradient index lens array such as a SELFOC lens is mounted as part of the writehead to focus light from the LEDs onto the belt 12. Other types of writers are also contemplated including laser writers, magneto-optic, liquid crystal and digital micromirror devices (DMDs).

The latent electrostatic image on belt 12 is developed with toner at a developer station 22. The developer station is illustrated as having four separate substations 24, 25, 26 and 27 for processing color images; the substations containing magenta, cyan, yellow, and black toner, respectively. Although four-color capability is illustrated, the present invention is applicable to monochromatic images also or to apparatus featuring one or more development stations.

As the toner image on belt 12 approaches a transfer station 28, an image receiver sheet 30 is fed from a supply 32. After transfer of the toner image to the receiver sheet, the receiver sheet is passed through a pair of heated fuser rollers 34 and 36. Mechanical and electrical cleaning of belt 12 is effected at a cleaning station 38. Transfer and detack of the receiver sheet from the belt is accomplished with suitable charges or other well known means (not shown). Other configurations of electrostatographic copier/printers may also be used.

Figure 2:
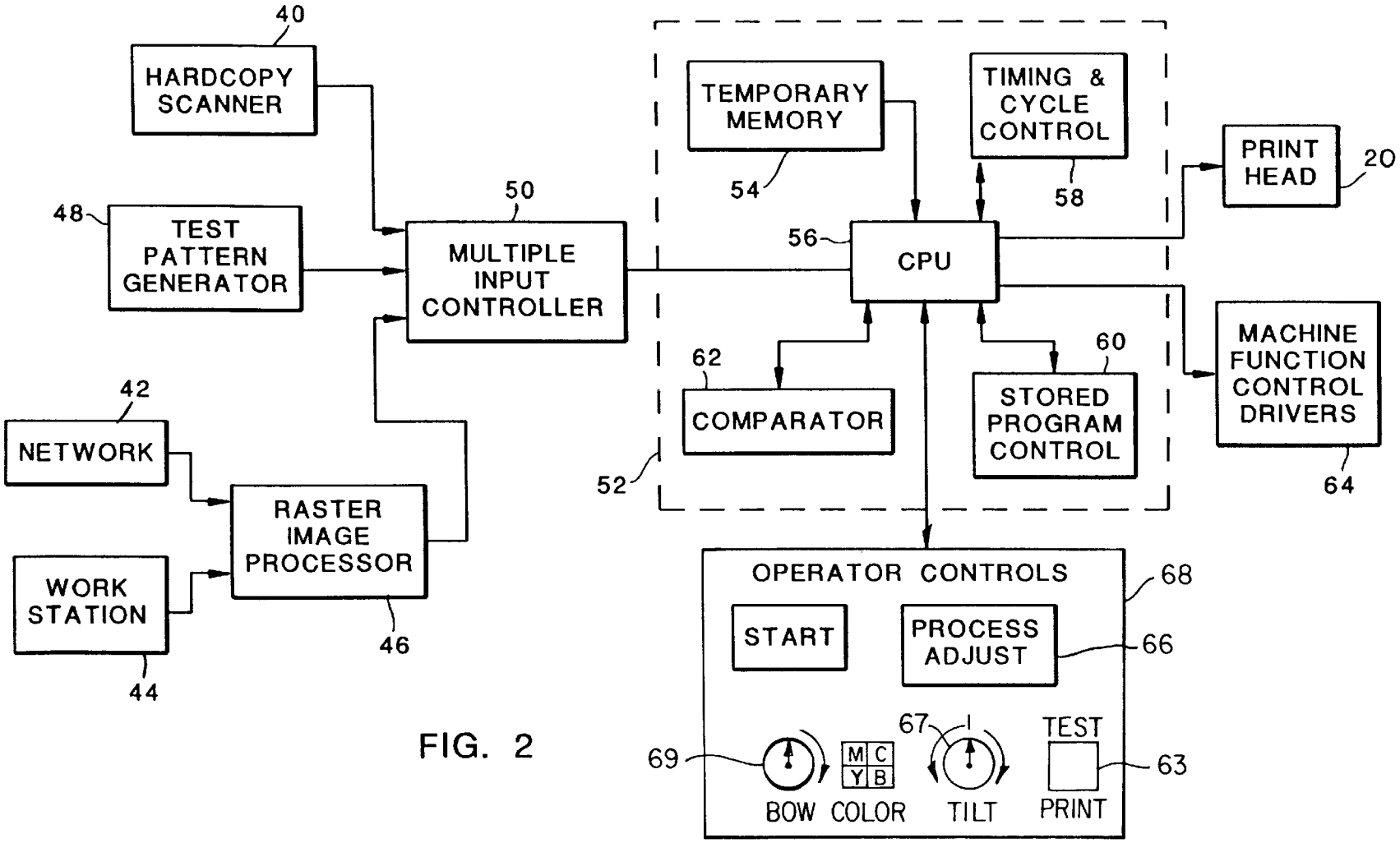
FIG. 2 is a block diagram of certain elements associated with the apparatus shown in FIG. 1.

Referring to FIG. 2, electrostatographic apparatus 10 may receive electrical image information signals in any one of several ways. For example, a document scanner 40 optically scans hard copy originals and converts the image to a rasterized electrical signal. However, a scanner is not required for use with the invention. Image information may also be obtained from electrical rather than optical sources. That is, electrical image information signals may originate (in so far as electrostatographic machine 10 is concerned) from a computer network 42 or a work station 44 or from a reader of data stored in various well known digital forms. Electrical image information signals from network 42 or work station 44 is rasterized by a raster image processor (RIP) 46. Image information may also come from a test pattern generator 48, to be explained in further detail below. The image signals are applied to writehead 20 by a multiple input controller 50 under control of a logic and control unit (LCU) 52.

Programming of a number of commercially available microprocessors is a conventional skill well understood in the art. The following disclosure is written to enable a programmer having ordinary skill in the art to produce an appropriate control program for a microprocessor. The particular details of any such program would, of course, depend on the architecture of the designated microprocessor. Referring still to FIG. 2, LCU 52 comprises temporary data storage memory 54, a central processing unit (CPU) 56, a timing and cycle control unit 58, a stored program control 60, and a data comparator 62. Temporary data storage memory 54 may be conveniently provided by a conventional Read/Write memory or Random Access Memory (RAM). Stored program control 60 includes one or more conventional Read Only Memories (ROM) containing operational programs in the form of binary words corresponding to instructions and values. The programs stored in ROM are responsive to various input signals for sequentially actuating and deactuating the work stations described above with reference to FIG. 1, as well as for controlling the operation of many other machine functions by means of control drivers 64, as disclosed in U.S. Pat. No. 3,914,047. The input signals are provided generally from buttons or other input controls that form a part of an operator control panel (OCP) 68. The reproduction parameters can be input using such buttons (generally referred to as process adjust 66) to indicate paper size or drawer or number of copies, stapled sets, etc. as is well known. The OCP may be in the form of a keyboard and screen or mouse-controlled or touch-controlled screen as is well known. Dedicated circuits for operating on the data may be used in lieu of or in conjunction with microprocessor control as is well known.

Figure 3:
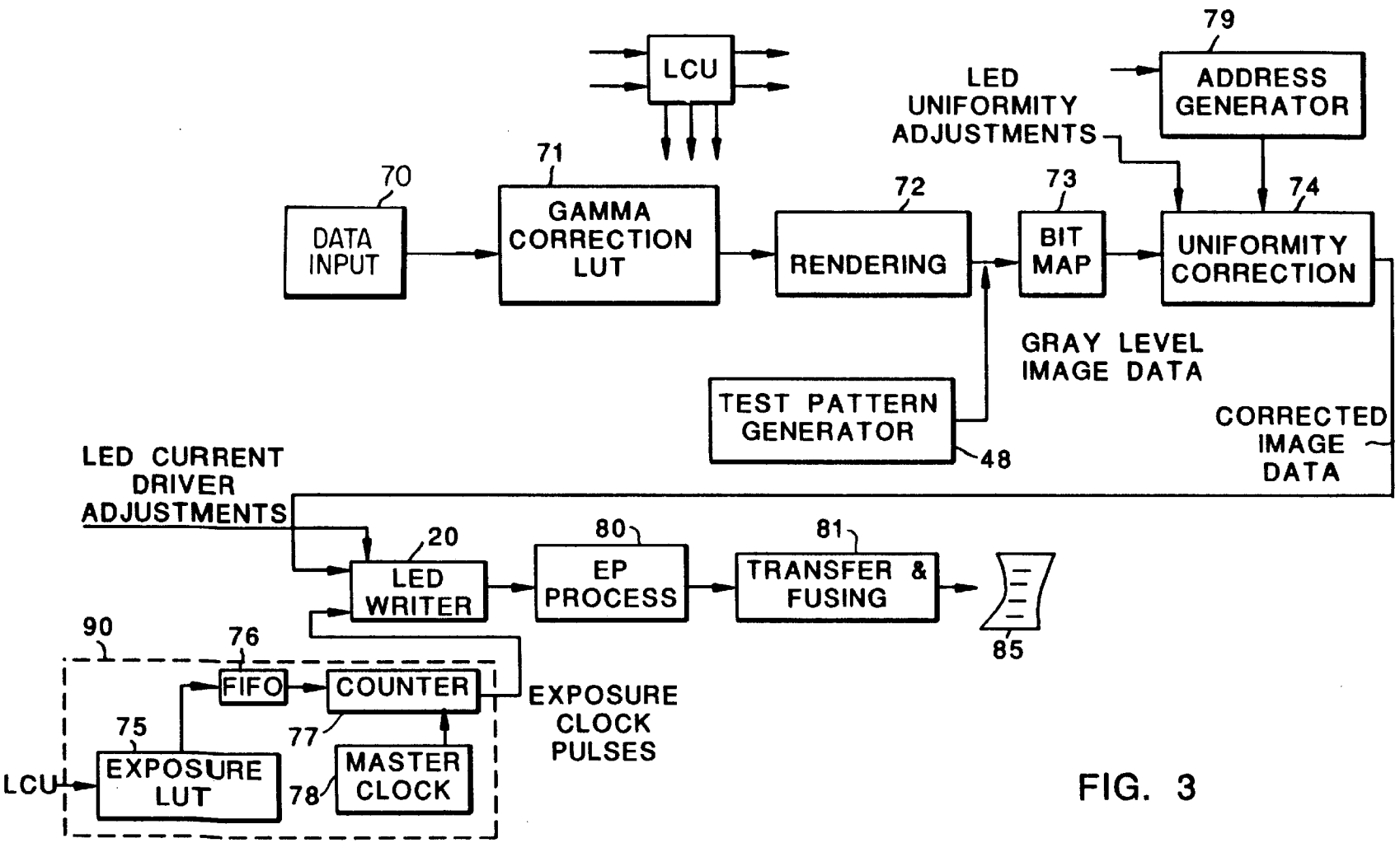
FIG. 3 is a block diagram of printer control elements and other elements used in the apparatus of FIG. 1.

With reference now to FIG. 3, a data input and LED writer have controls which may be represented by the block diagram shown therein. The data input 70 may comprise one or more of the devices described above for providing digital image data. In this example, assume that the scanner array can scan at 600 dots per inch (dpi) resolution both in the cross-track and in-track directions and the LED printer can print at 600 dpi resolution both in-track and cross-track. Of course, these numbers are just exemplary and other combinations of scanner and printer resolutions are possible and need not be identical resolutions in both directions.

In operation, the data input may provide pixel data represented, for example, by 8-bits of digital data per pixel. A gamma correction look-up table 71 is entered with the 8-bit signal to correct for nonlinearities in the electrophotographic process 80. Thus, in operation of the gamma correction LUT, an 8-bit image data signal input thereto representing density of a current pixel is transformed into an 8-bit gamma corrected pixel value. The pixel value may be subject to a rendering process in block 72 which outputs a grey level signal of say 4-bits for each pixel. A bit map memory array 73 stores the signals in a proper order for retrieval upon printing. When a page of memory is filled representing the data for a next image frame to be printed, data is removed from the bit map memory and individual pixels subject to correction for nonuniformity by uniformity correction circuit 74 in accordance with a process described in U.S. Pat. Nos. 5,300,960, 5,200,765 and U.S. application Ser. No. 08/175,079. In the course of correcting the LEDs for nonuniformities, each 4-bit signal which represents 0 to 15 different grey levels in lightness space is converted to, for example, a 6-bit digital signal representing an exposure time that when that particular LED is energized for that period of time and with a predetermined current level will provide the exposure density represented by the 4-bit grey level signal. Thus, even though there are differences in the emission characteristics of LEDs on the printhead due to differences in processing of the LEDs, the LEDs can be corrected and used to record generally uniformly through control of exposure time. The correction scheme described herein is exemplary and of course other types of correction may also be used. In a FIFO memory 76 associated with an exposure clock 90, various values are stored to control the timing of exposure clock pulses. As noted in U.S. Pat. No. 5,300,960, exposure clock pulses may be generated by loading a counter 77 with count values. The counter counts clock pulses from a high frequency master clock 78 and when a loaded count value is reached, an exposure clock pulse is generated that is output to a counter on the LED writer 20 that counts the exposure clock pulses. A count output by a comparator on the writer is compared with the uniformity corrected 6-bit pixel data signal to control when the LED that is to record that pixel is turned on and turned off. By providing different exposure values in the FIFO memory different count values are loaded into the counter and thus different periods can be created between exposure clock pulses. In another approach disclosed in U.S. Pat. No. 5,657,069, a shift register is loaded with digital 1's and 0's and these are shifted out under a master clock control so that the 1's represent exposure clock pulses wherein different arrangements of the 1's and 0's provide different patterns of exposure clock pulses. The LED writer is further characterized by the control of amount of driver current in accordance with driving circuits described in U.S. Pat. Nos. 5,257,039 and 5,253,934. The selective activation of the LEDs to generate light modulates the electrostatic charge pattern on the belt to create a latent electrostatic image. As noted above, this image is developed with electroscopic visible toner particles as part of the electrophotographic process 80 and then transferred to a record member, such as a sheet of plain paper or other type of sheet. The transferred image is then fused in a fusing step 81 to the record member to generate a printed document 85.

The apparatus and method of the invention provides for density consistency and uniformity in an electronic copier/printer which has an electronic writer. In the apparatus of the invention, image data for one or more test images are stored electronically in the test pattern generator 48 when a calibration program is entered by entering a process adjust input button.

Figure 5:
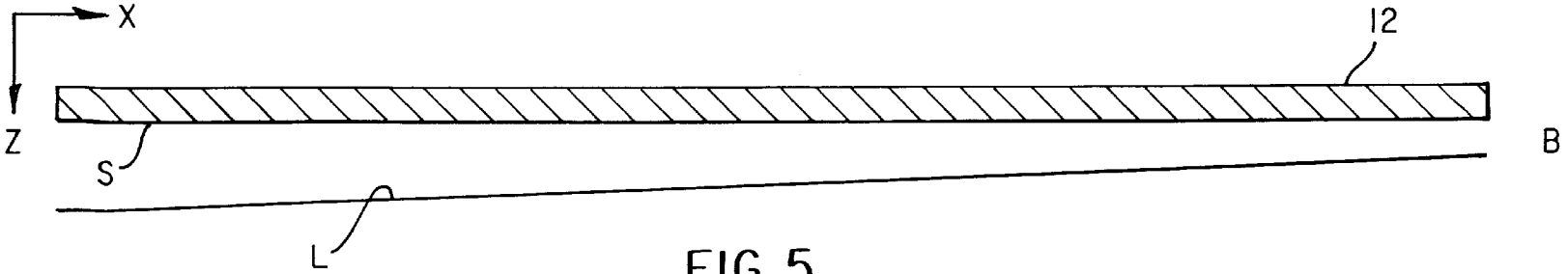
FIG. 5 is a schematic illustration of a photoconductive recording member and a line depicting a process element such as a corona charging wire or a plane of LEDs and illustrating a tilt type of relationship between the surface of the photoconductive recording member and the process element in the apparatus of FIG. 1.
Figure 6:
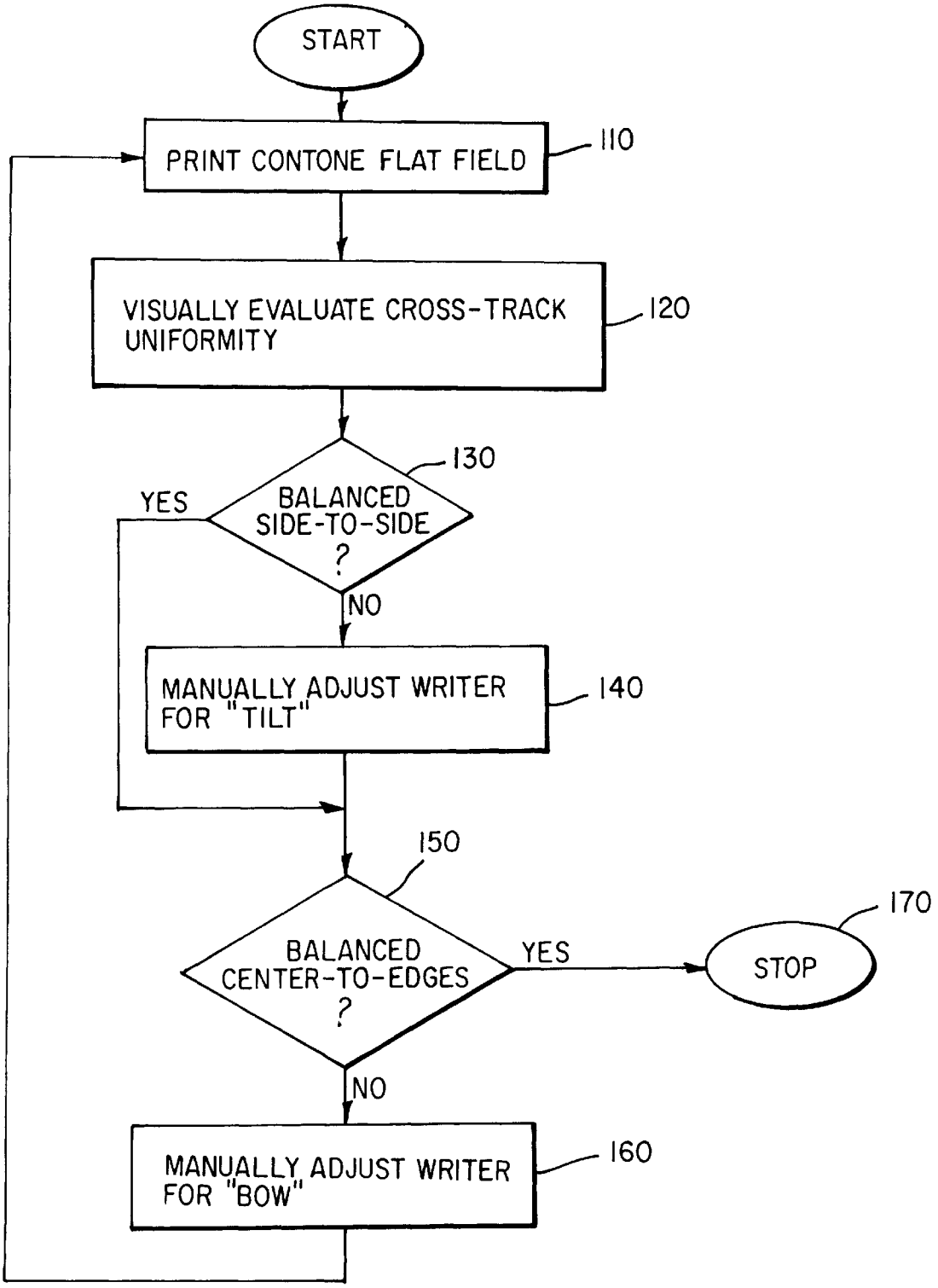
FIG. 6 is a flowchart illustrating a procedure for non-uniformity correction in calibrating the apparatus of FIG. 1 in accordance with a method of the invention.

In order to provide uniformity adjustments the procedure set forth in the flowchart of FIG. 6 is followed. Initially, a test print 85 is made using test print data stored in a memory associated with test pattern generator 48. This test print data is printed and processed to provide a flat field contone (continuous tone) print, step 110. The print is then examined by the operator and for cross-track uniformity, step 120. As noted in FIG. 5, the cross-track density profile may fall off to one side due to z-plane skewing, relative to the photoconductive belt 12, of the printhead, i.e., the printhead and/or Selfoc lens is not parallel to the photoconductive belt; or the charger or toning station is also not parallel or is contaminated. The skewed element is represented by the line L in FIG. 5 and the cross-section of the photoconductive belt 12 is shown wherein the x direction is perpendicular to the process direction and is generally known as the cross-track direction of the belt. The process direction would be in the Y direction or perpendicular to the plane of FIG. 5.

Figure 4:
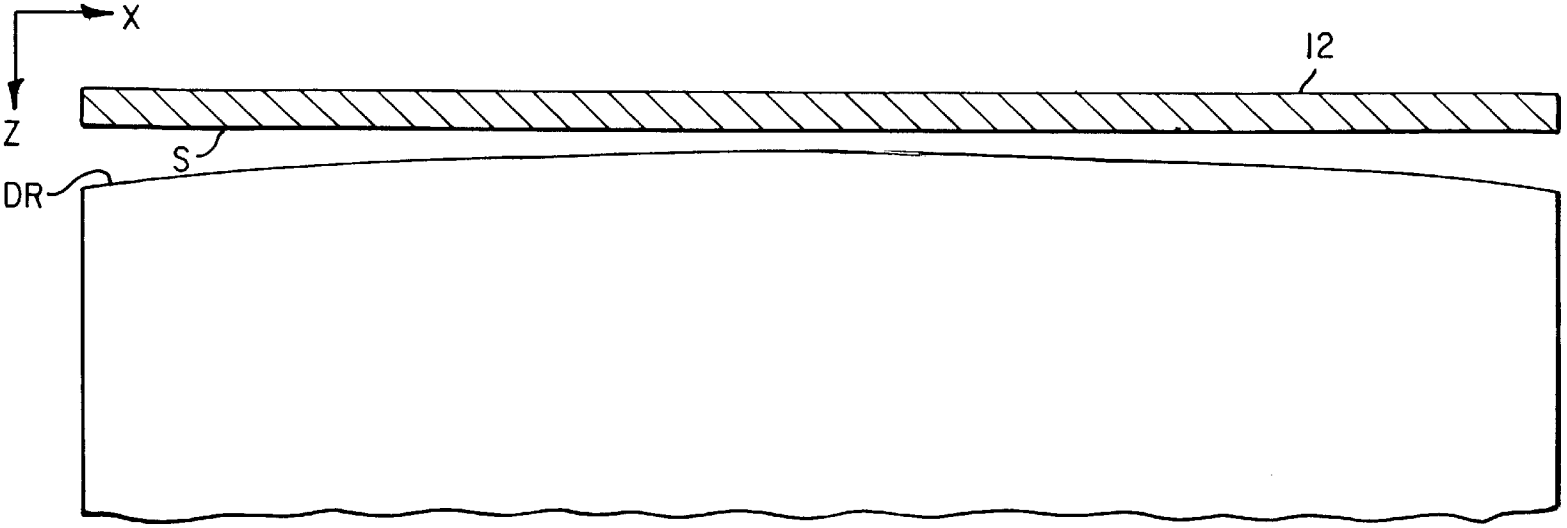
FIG. 4 is a schematic illustration of a portion of a development roller or other process element and a photoconductive recording member forming a part of the apparatus of FIG. 1 and illustrating a bow type of relationship between the surface plane of the process element and the surface of the photoconductive recording member to be operated upon by the process element.

With reference also to FIG. 4, a different problem with cross-track uniformity may arise due to bowing in a process station such as, for example, might occur in a development station. In a development station a bow in a development roller (DR) may be present so that the development gap, between the roller and the image to be developed on the photoconductive surface S of photoconductive belt 12, is not uniform.

Figure 8:
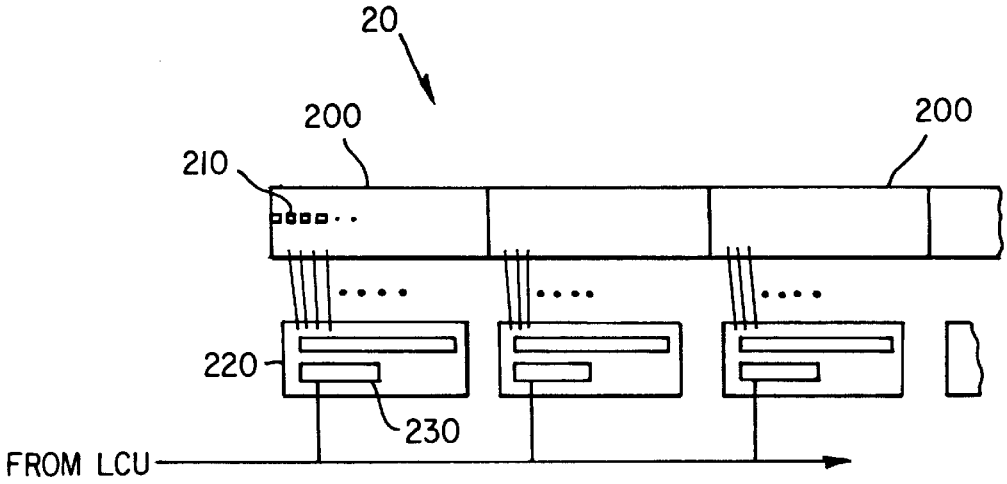
FIG. 8 is a schematic of a writehead used in the apparatus of FIG. 1.
Figure 9:
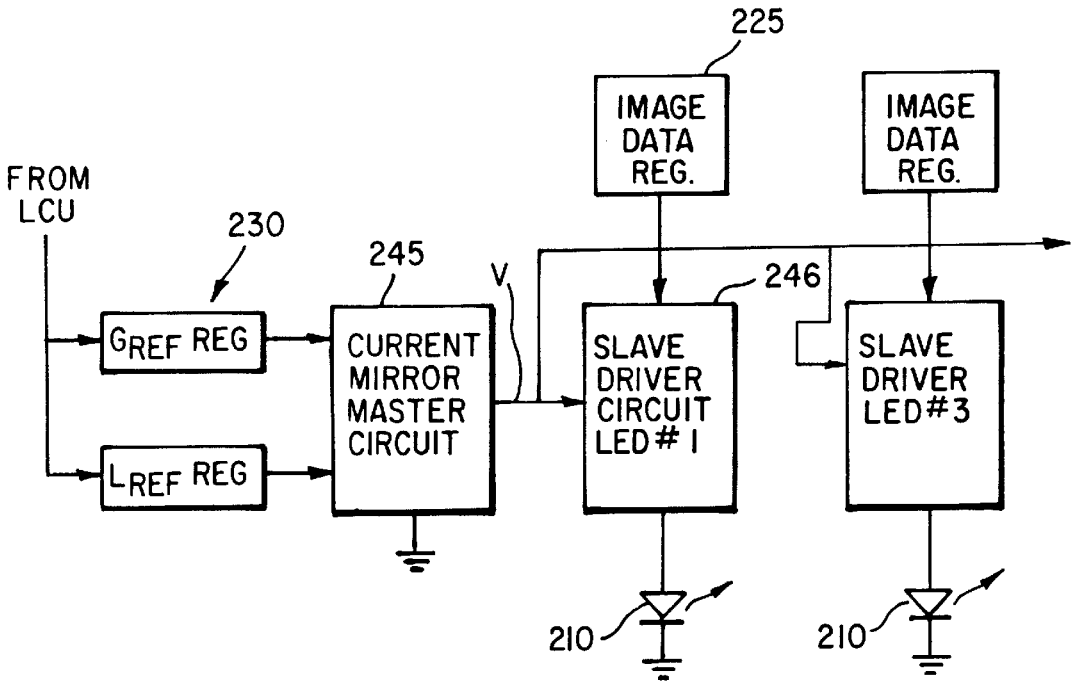
FIG. 9 is a schematic of a portion of a driver chip on the writehead of FIG. 8.

After examining the test print the operator determines if the print is balanced side to side or top to bottom. The examination will depend upon the orientation of the sheet as it is positioned for transfer. Assuming, for an 8 ½× 11" sheet, that the printer prints the long dimension in the cross-track direction the image is examined from side to side along the long dimension for cross-track uniformity, step 130. The examination will be referred to as side-to-side as the sheet is best oriented so that it can be viewed from left to right. If the operator, after viewing the sheet, determines that there is not side-to-side uniformity due to a tilt alignment problem a tilt adjustment is made manually using tilt knob 67 provided on the OCP 68. Since the direction of tilt can be an issue, the test may have printed or pictorial indicia indicating orientation for holding the sheet and information on which direction to rotate the tilt knob, clockwise or counterclockwise for inputting the appropriate correction for tilt. The information on the test print can provide direction that density appears to increase from left to right then rotate the tilt knob clockwise for example. The information, i.e., words, on the sheet are printed so that the operator will hold the test page in the orientation for examining the test print from left to right which represents and allows for easier examination for cross-track uniformity. The amount of rotation of the tilt knob by the operator will be an adjustment that a skilled operator can learn through experience or by making gradual adjustments and making and viewing test prints using test print button 63. Conversely, if density increases from right to left the indicated instruction printed on the test print will instruct the operator to rotate the tilt knob counterclockwise. Rotation of the tilt knob to a particular setting causes the setting to be input to the LCU. The LCU is programmed to respond to this setting and provide an adjustment to the current drivers which is a selective adjustment. With reference to FIGS. 8 and 9, a schematic of a portion of an LED writer is illustrated. As is well known such a writer will include a series of LED chip arrays 200 that are mounted end to end on a support. Each array includes a series of LEDs 210, for example 196 LEDs, arranged on a single row. The LED chip arrays when arranged end to end form a single row across the printhead which may include, for example 5000 LEDs evenly spaced to provide, for example, 600 LEDs to the inch. A driver chip 220 is associated with each LED chip array. The driver chip includes data registers 225 storing image data for each LED driven by the driver chip. Additionally, each driver chip includes a current data register 230 for storing digital current data for determining the level of driver current driven by each driver circuit. The image data in each image data register 225 is used to determine pulse duration for recording a pixel. The digital current data in register 230 is a 16-bit signal wherein 8-bits defines a local adjustment reference signal ($L_{REF}$) and 8-bits defines a global adjustment or reference signal ($G_{REF}$). The 8-bits associated with the global adjustment is a similar signal provided to all driver chips on the printhead and when changed is changed similarly to all the driver chips, hence the name global. The local adjustment $L_{REF}$ is specific to each driver chip and thus different driver chips may have different 8-bit signals stored in their $L_{REF}$ registers to provide selective adjustment to each as needed. The 16-bit signal stored in the register 230 is used to control a current level in a current mirror master circuit 245. The current developed in this circuit generates a voltage which is connected to individual slave circuits 240 that generate current for driving respective LEDs. The current for driving the LEDs mirrors or is equal or proportional to that flowing in the master circuit.

Thus, by providing adjustments to the tilt control knob, the LCU is programmed to change the current data in each of the $L_{REF}$ registers accordingly with the change of the data being adjusted in accordance with position of the associated LED array. For example, if the tilt adjustment indicates a need for greater exposure by LEDs at the left end of the printhead as might be needed in the case illustrated in FIG. 5 the adjustments are made selectively to each driver chip so that more change to driver current is made to the driver chip at the left end and corresponding less additional driver current changes provided to the driver chips as one proceeds from left to right across the printhead.

Although only one driver chip is shown associated with each LED chip array it will be appreciated that it is preferred to have two driver chips associated with each LED chip array one located to each side of the LED chip array, so that one driver chip drives odd-numbered LEDs and the other drives even-numbered LEDs.

With reference again to the flowchart, the test print is also reviewed for possible imbalance center to edge as might occur with a bow type of misalignment in a process member such as a development station. Accordingly, the operator can turn the bow adjustment knob 69 to input a desired correction for bow also. The inputted correction at the bow adjustment knob causes a signal to be input to the LCU which is programmed to provide specific $L_{REF}$ signals to particular driver chips to adjust for bow and tilt. The operator may prefer to do the bow and tilt adjustments separately and print out a test print after performing a tilt adjustment and then view the test print for any needed change to tilt before inputting the bow adjustment. If a bow adjustment is indicated as necessary, step 150, the adjustment is made. In determining a need for correcting for bow, the operator can note that density falls off from center to edges. The correction for bow will provide greater driver current adjustments to driver chips located at the edges of the printhead with the amount of adjustments to the chips being provided according to position relative to the center of the printhead so that those closer to the center receive less adjustment. It will be appreciated that in making adjustments to driver chips that because each driver chip is slightly different due to manufacturing process considerations or because of slight differences between the LEDs that are driven, there is the consideration of using the $L_{REF}$ signal to also assist in providing for LED brightness uniformity adjustments. A test print is then printed after such adjustment. The adjustments for bow and tilt can be made until a test print is made which appears optimum, step 170. The machine is now adjusted for making of regular prints.

Figure 7:
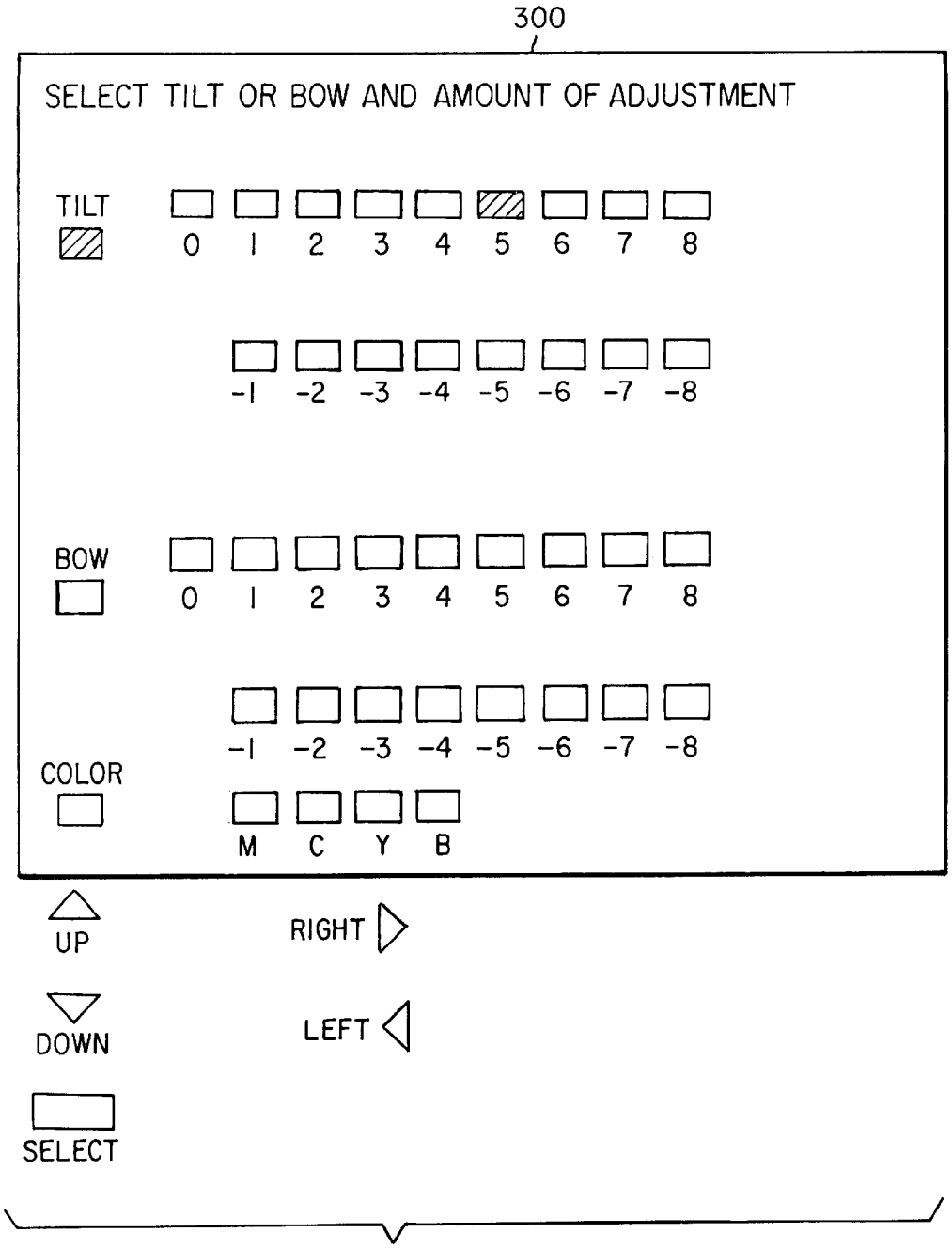
FIG. 7 is a schematic of an alternate embodiment of a manual correction device in accordance with the invention and using a display screen forming part of an operator control interface that may form a part of an electrostatographic apparatus such as that described with reference to FIG. 1.

In FIG. 7, there is indicated a screen display that is part of an operator control panel for providing inputs for bow and tilt correction. By use of the up, down, right, left buttons, a selection may be input for amount of tilt and bow correction and the selection displayed by coloration or presence of a cursor as indicated by "tilt" being highlighted and "5" being highlighted for tilt amount. In this display, bow may be indicated for both positive bow and its inverse in the event of a member having an opposite form of bow misalignment, i.e, spacing between process station and photoconductor at the center is greater than at the ends. Since different color development stations may provide one or more different bow or tilt problems, the display provides for an indication of bow and tilt for each color separation image. In such a case, test prints are made in each color separation image and adjusted accordingly pursuant to the flowchart of FIG. 6

The above description provides an improved adjustment feature for a reproduction apparatus without the need to scan test prints by a scanner for individual LED to LED corrections. Rather, the approach provided herein provides for correction on a group basis as is convenient for control of driver current to each driver chip. Thus, correction is simplified for correction for bow and tilt on an image frame basis since only one color is developed in an image frame and the correction current data can be communicated by the LCU to the writer during an interframe period so that different driver currents are provided when recording different colors.

The invention has been described in detail with particular reference to preferred embodiments thereof, but it will be understood that variations and modifications can be effected within the spirit and scope of the invention.

What is claimed is:

1. An electrostatographic reproduction apparatus comprising:

an electrostatographic recording member movable in a process direction;

a writer including a plurality of recording elements, the writer including driver circuitry for actuating selected recording elements to record electrostatic latent images on the recording member;

a development station operative to develop the latent images;

a transfer station operative to transfer developed images to a record member; and an operator selectable adjustment controller for generating adjustments in operation of the recording elements to compensate for a misalignment of a process station in the apparatus wherein the controller adjusts current to recording elements by making greater relative current changes to recording elements adapted to record at locations adjacent an edge of the recording member than to recording elements adapted to record at locations adjacent the middle of the recording member, without the need of a scanner to scan a test print printed by the apparatus and without the need of the operator to identify specific recording elements and provide specific corrections to specific recording elements.

2. The apparatus of claim 1 wherein the controller has a manual selection control located at an operator control panel.

3. The apparatus of claim 1 wherein the controller has a manual selection control that is part of a key input in cooperation with a visual screen display.

4. The apparatus of claim 1 wherein the manual selection control is adjustable to compensate for a tilt misalignment.

5. The apparatus of claim 1 wherein a manual selection control is adjustable to compensate for a bow misalignment.

6. An electrostatographic reproduction apparatus comprising:

an electrostatographic recording member movable in a process direction;

a writer including a plurality of recording elements, the writer including driver circuitry for actuating selected recording elements to record electrostatic latent images on the recording member;

a development station operative to develop the latent images;

a transfer station operative to transfer developed images to a record member; and an operator selectable bow adjustment controller for generating adjustments in operation of the writer to compensate for a bow-related misalignment of a process station in the apparatus, without the need of a scanner to scan a test print printed by the apparatus and without the need of the operator to identify specific recording elements and provide specific corrections to specific recording elements.

7. The apparatus of claim 6 wherein the bow controller adjusts current to recording elements by making greater relative current changes to recording elements adapted to record at locations adjacent an edge of the recording member than to recording elements adapted to record at locations adjacent the middle of the recording medium.

8. The apparatus of claim 6 wherein the bow controller has a manual selection control located at an operator control panel.

9. The apparatus of claim 6 wherein the bow controller has a manual selection control that is part of a key input in cooperation with a visual screen display.

10. The apparatus of claim 6 and including an operator selectable tilt adjustment controller for generating adjustments in operation of the writer to compensate for a tilt-related misalignment of a process station in a direction cross-track of the process direction.

11. An electrostatographic reproduction method for use in a reproduction apparatus having a plurality of process stations, the method comprising:

moving an electrostatographic recording member in a process direction;

operating a plurality of recording elements on a writer to imagewise expose the recording member to form electrostatic latent images on the recording member, the writer including driver circuitry for actuating selected recording elements;

moving the exposed recording member through a development station to develop the latent images;

transferring developed images to a record member; and manually adjusting an operator selectable adjustment controller for generating adjustments in operation of the recording elements to compensate for a misalignment of a process station in the apparatus, without the need of a scanner to scan a test print printed by the apparatus and without the need of the operator to identify specific recording elements and provide specific corrections to specific recording elements.

12. The method of claim 11 wherein the controller adjusts current to recording elements by making greater relative current changes to recording elements adapted to record at locations adjacent one edge of the recording member than to recording elements adapted to record at locations adjacent the other edge of the recording member.

13. The method of claim 11 wherein the controller has a manual selection control located at an operator control panel and the operator manually adjusts the control.

14. The apparatus of claim 11 wherein the controller has a manual selection control that is part ol a key input in cooperation with a visual screen display and the operator manually adjusts the control.

15. The method of claim 11 wherein a test print is made and instructions provided on the test print and the instructions are oriented for viewing by the operator so as to permit for viewing of a test image on the test print with the cross-track process direction used in forming the image being observable by the operator by viewing from left to right.

16. The method of claim 11 wherein the controller adjusts current to recording elements by making greater relative current changes to recording elements adapted to record at locations adjacent one edge of the recording member than to recording elements adapted to record at locations adjacent the middle of the recording member.

17. The method of claim 16 wherein a test print is made and instructions provided on the test print and the instructions are oriented for viewing by the operator so as to permit for viewing of a test image on the test print with the cross-track process direction used in forming the image being observable by the operator by viewing from left to right.

18. The method of claim 11 wherein the controller adjusts current to recording elements by making greater relative current changes to recording elements adapted to record at locations adjacent the middle of the recording member than to recording elements adapted to record at locations adjacent an edge of the recording member.

19. The method of claim 18 wherein a test print is made and instructions provided on the test print and the instructions are oriented for viewing by the operator so as to permit for viewing of a test image on the test print with the cross-track process direction used in forming the image being observable by the operator by viewing from left to right.

* * * * *